US005615624A

United States Patent [19]

Terry et al.

[11] Patent Number: 5,615,624

[45] Date of Patent: Apr. 1, 1997

[54] PASS THROUGH TRANSACTION DRAWER WITH A HINGED SECURITY FLAP

[75] Inventors: Dan L. Terry, Houston; Jackson G. Weaver, Cypress, both of Tex.

[73] Assignee: MCE Systems Corp., Houston, Tex.

[21] Appl. No.: 76,244

[22] Filed: Jun. 10, 1993

[51] Int. Cl.[6] ..... E06B 7/32

[52] U.S. Cl. ..... 109/19; 109/66; 232/43.1

[58] Field of Search ..... 109/5, 10, 11, 109/15, 16, 19, 66; 232/43.1–43.4, 44

[56] References Cited

U.S. PATENT DOCUMENTS

| | | | |
|---|---|---|---|
| 1,654,692 | 1/1928 | Marois . | |
| 2,223,169 | 11/1940 | Ellithorpe | 109/19 |
| 2,648,300 | 8/1953 | Beedle | 109/19 |
| 3,059,840 | 10/1962 | Graber | 232/44 |
| 3,145,918 | 8/1964 | Higgins . | |
| 3,390,833 | 7/1968 | Harris | 232/43.3 |
| 4,084,518 | 4/1978 | Carlson | 232/43.3 |
| 4,135,658 | 1/1979 | Hagberg | 232/43.1 |
| 4,190,004 | 2/1980 | Richardson | 232/44 |
| 4,393,789 | 7/1983 | Glotfelter | 109/19 |
| 4,517,901 | 5/1985 | Clark | 109/19 |
| 4,595,246 | 6/1986 | Bross | 312/111 X |
| 4,640,200 | 2/1987 | Richardson | 109/19 |
| 5,205,224 | 4/1993 | Durst | 109/66 X |

FOREIGN PATENT DOCUMENTS

| | | | |
|---|---|---|---|
| 592235 | 10/1977 | Switzerland | 109/19 |

OTHER PUBLICATIONS

Shure Manufacturing Corporation Shure Series Shuresafe Product Brochure.

Shuresafe Security Systems (Featuring Thur–Wall Transaction Products) Product Brochure.

Point Blank Body Armor Brochure.

Shure Manufacturing Corporation Drawings (4 sheets) Drawing No. FE–1332–1, FE–1332–2, FE–1332–3, FE–1332.

Creative Industries, Inc. Bullet Resistant Product Brochure.

*Primary Examiner*—Suzanne L. Dino

[57] ABSTRACT

A pass-through transaction drawer with a hinged, moveable security flap is disclosed to permit the conveyance of articles, in a relatively secure manner, between an attendant or clerk within a building and a customer outside the building irrespective of the drawer size or depth. The hinged, moveable security flap is only moveable by the attendant to maximize security. The security flap can be adapted with a small contents tray to facilitate transactions involving the exchange of money or credit cards. To facilitate transactions which may require deeper transaction drawers, the transaction drawer may be adapted with an interior partition to compartmentalize a relatively deep drawer, whereby relatively larger, bulky items are conveyed in the deeper compartment and smaller articles are conveyed in the shallow compartment.

5 Claims, 4 Drawing Sheets

FIG. 1
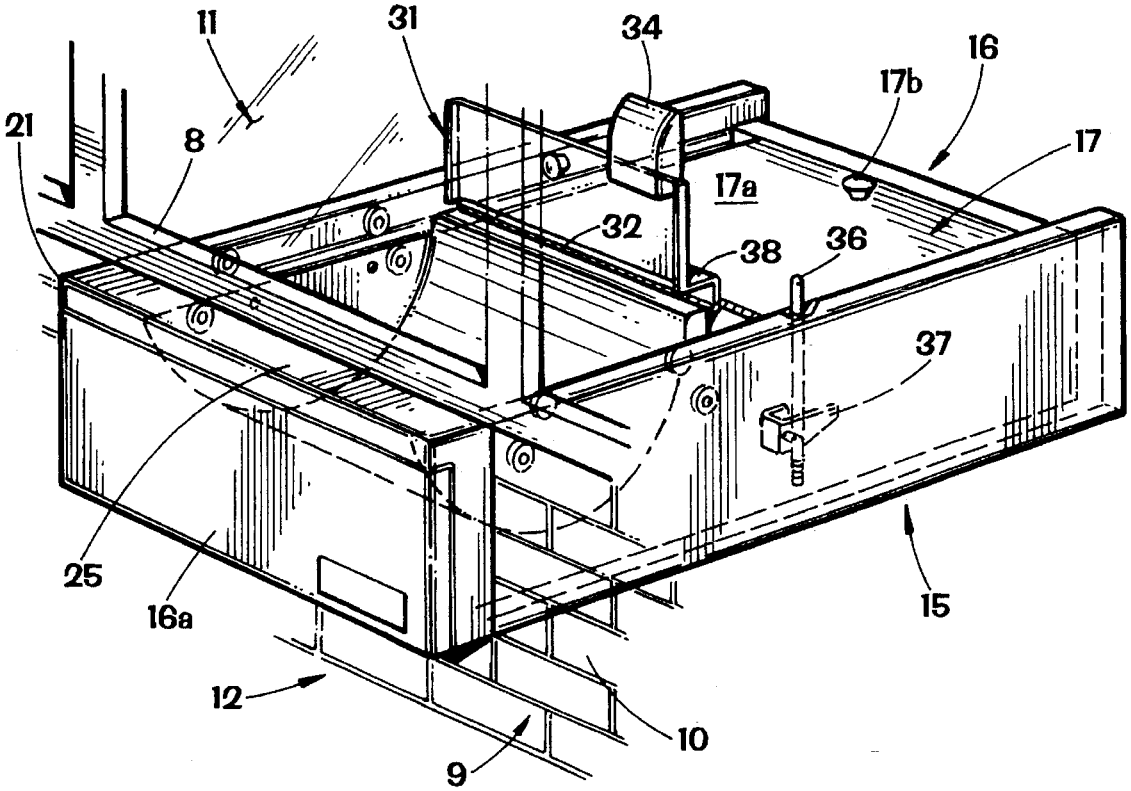
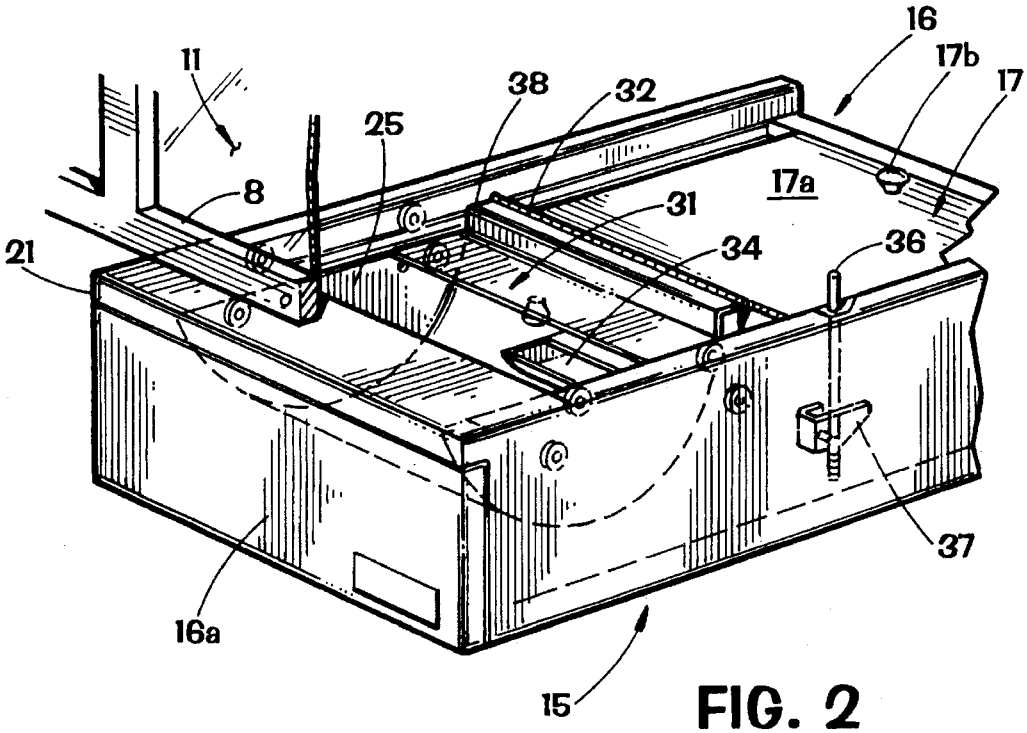
FIG. 2

FIG. 5
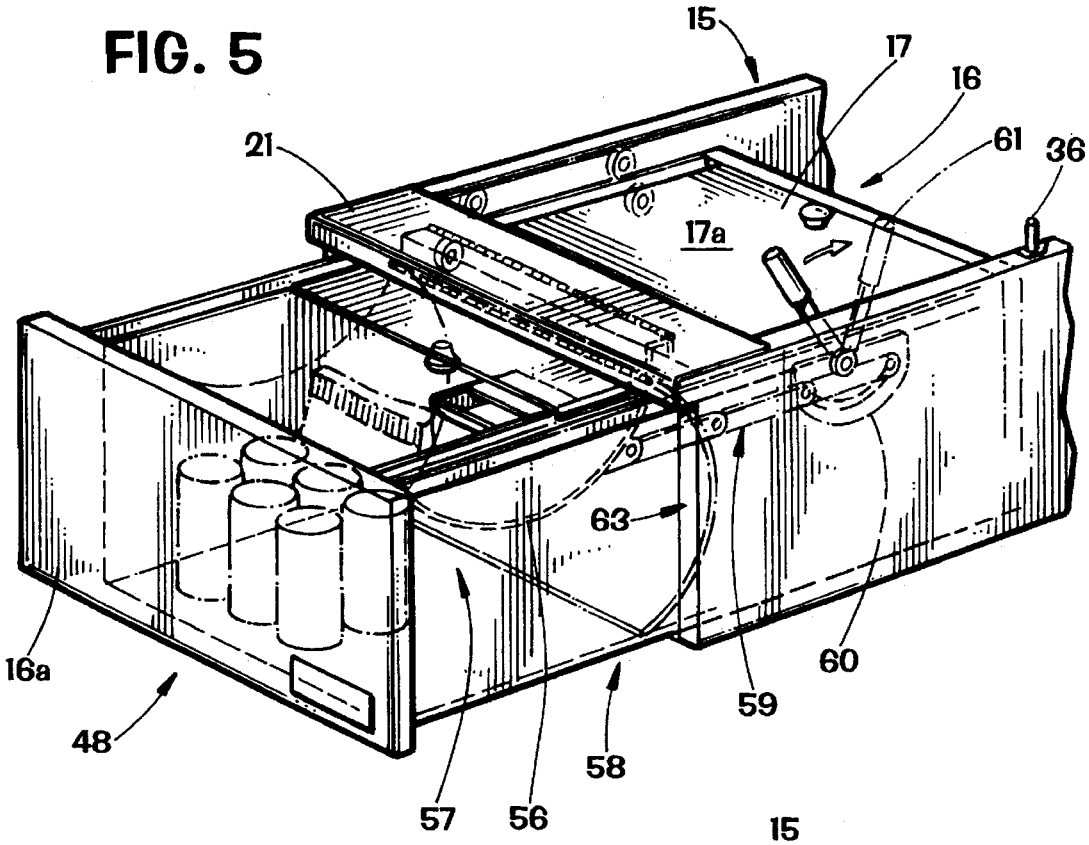
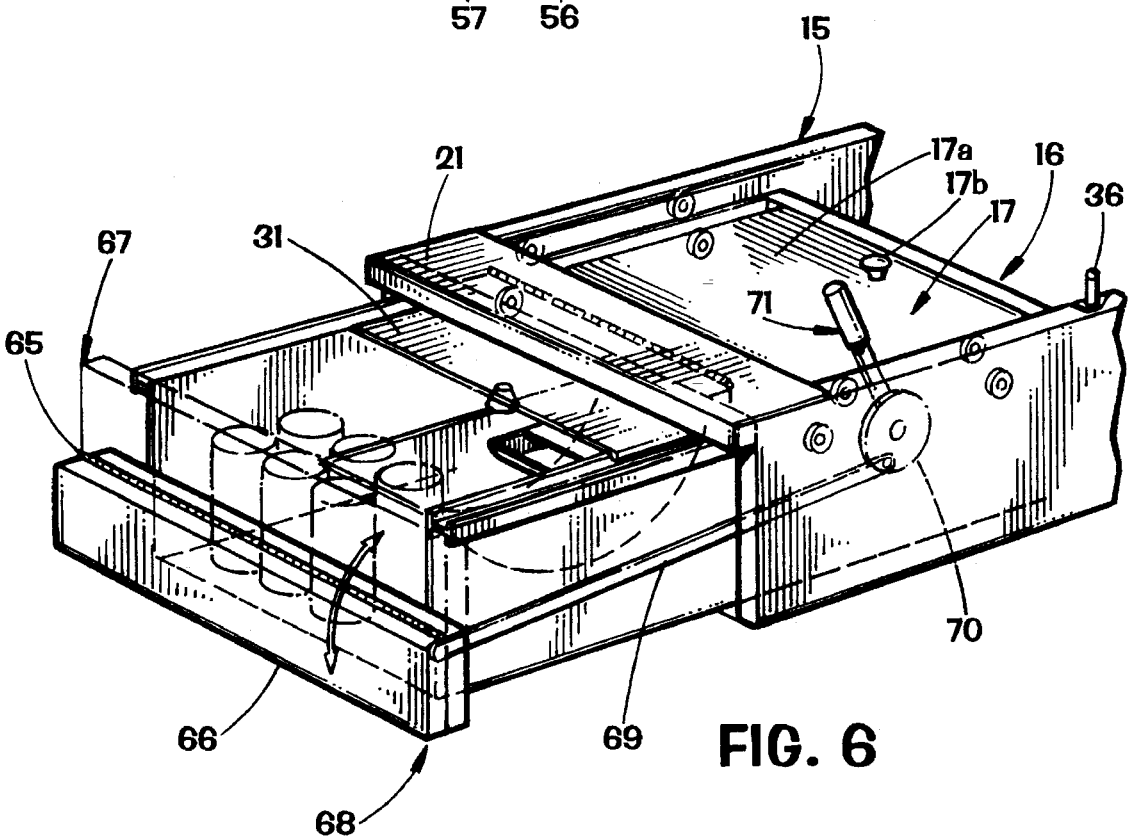
FIG. 6

PASS THROUGH TRANSACTION DRAWER WITH A HINGED SECURITY FLAP

BACKGROUND OF THE INVENTION

This invention relates to a pass-through transaction drawer such as is typically provided in a building, such as a convenience drive-up food store, a service station attendant's booth, a free-standing kiosk, a walk-up bank teller window or the like. Such transaction drawers are conventionally located immediately below a window behind which an attendant, clerk, teller, etc. is stationed so as to permit the attendant to view the customer approaching his window and to personally transact business with the customer while the attendant, together with the cash register and cash drawer, remain within a relatively secure and locked enclosure.

Reference may be made to U.S. Pat. No. 4,640,200 which discloses a prior art transaction drawer. This above-noted prior art transaction drawer is provided with a removable "deal tray" which facilitates "small" transactions which only involve cash, credit cards, and small articles (e.g. package of chewing gum, cigarettes, and the like), and yet the disclosed transaction drawer also permits the transfer of relatively large bulky packages, such as cans of oil or packages of beverages when the removable deal tray drawer is removed. One of the drawbacks of the prior art transaction drawer is that the "security" which is afforded by the removable deal tray is essentially lost by the removal of the small deal tray in an effort to accommodate a transaction involving large bulky packages. In today's security conscious world the loss of the security offered by the removable deal tray (referred to in the 4,640,200 patent as the removable "deal tray" at col. 5, line 11–12) is unacceptable. The removal of the deal tray for a transaction for bulky items may permit an assailant to insert a gun or other weapon through a partially open drawer and thereby threaten an attendant with bodily harm. These types of heists typically require the attendant to open the personnel access door, provide the assailant with the day's proceeds from the cash drawer, or otherwise respond to the assailant's demands or risk a loss of life if such demands are not satisfied. Deeper drawers for bulkier items thereby exacerbate the risk or a holdup by providing more space for the insertion of a firearm or other life threatening weapon.

There has been a long-standing need for a transaction drawer which accommodates the convenience of both small transactions (e.g. transferring cash, credit cards, and small items) and bulky transactions (e.g. cans of oil, six-packs of beverages) without the attendant loss of security as heretofore described.

SUMMARY OF THE INVENTION

Among the several objects and features of the present invention may be noted the provision of a transaction drawer assembly which readily facilitates small transactions, such as those involving cash, credit cards, and small articles; and yet still permits the transfer of relatively large bulky packages, such as a loaf of bread, container of milk or juice, cans of oil and six-packs of beverages, and the like, while still providing the attendant with a secure enclosure by minimizing the risk of the insertion of a weapon through a partially open drawer in the process of transaction involving bulky items;

The provision of such a transaction drawer which facilitates the use (by the attendant) of the security features provided by the present invention each time a transaction is made irrespective of whether the transaction involves small or bulky items;

The provision of such a transaction drawer which minimizes the risk of an attendant's ability to defeat the security features of the present invention;

The provision of such a transaction drawer which, when open or closed, limits a person's ability to insert a firearm or other life-threatening weapon;

The provision of such a transaction drawer which provides easily serviceable and replaceable rollers and bearings thereby minimizing the "down-time" of such a drawer during maintenance;

The provision of such a transaction drawer which may be readily installed in the wall of a building and which does not adversely affect the outward appearance of the building;

The provision of such a transaction drawer which when closed, provides a relatively tight weather seal for the building;

The provision of such a transaction drawer which includes a cash drawer or cash box, the contents of which are inaccessible to the customer outside the building;

The provision of such a transaction drawer which when closed, is positively locked in its closed position, preventing opening of the transaction drawers from the exterior of the building;

The provision of such a transaction drawer which, when closed, is also tamper resistant;

The provision of a transaction drawer which is provided with a readily graspable handle such that the attendant or clerk within the building may close and latch the transaction drawer in a relatively short time; and The provision of such a drawer which is of rugged and durable construction, which is reliable in operation, which is convenient to use, both to the attendant and the customer, while affording the attendant with reliable security for all types of transaction.

Other objects and features of this invention will be in part apparent and in part pointed out hereafter.

In summary, a pass-through transaction drawer of the present invention comprises a frame which is adapted to be installed in the opening in the wall of a building or kiosk or the like with the frame including rollers and bearings. A drawer with a track adapted to the rollers and bearings mounted in the frame is selectively movable by the attendant within the building or kiosk between a retracted position in which the drawer is within the building or kiosk and in which the opening in the wall of the building or kiosk is closed, and an extended position in which the drawer projects out beyond the wall of the building permitting a customer to have access to the interior of the transaction drawer. Security of the attendant or clerk is facilitated by the use of a security flap which effectively blocks the opening between the interior and the exterior of the building when the drawer is partially open. In one embodiment of the present invention the drawer is adapted for large bulky items and small items without modification of the transaction drawer by the attendant or clerk while still providing security to the attendant irrespective of the depth of the drawer.

BRIEF DESCRIPTION OF THE DRAWINGS

FIG. 2 is a perspective view similar to FIG. 1. with a transaction drawer shallower than that illustrated in FIG. 1, such transaction drawer shown in the retracted or closed position with the movable, hinged security flap shown in a horizontal position.

FIG. 5 is a perspective view of the pass-through transaction drawer of the present invention; illustrating an alternate embodiment of the present invention, with a transaction drawer which can be selectively converted from a shallow to a deeper drawer (to accommodate bulky items), such conversion selected by the attendant through the use of a conveniently mounted handle; the transaction drawer shown in the extended or opened position with the movable, hinged security flap shown in a horizontal position and the cash box located within the transaction drawer with the lid to the cash box in its closed position.

FIG. 6 is a perspective view of the pass-through transaction drawer of the present invention; illustrating an alternate embodiment of the present invention, with a compartmentalized transaction drawer and a moveable door (shown in the opened position) at the front of the transaction drawer, such moveable door can be selectively opened by the attendant to facilitate the removal of bulky items by the customer, the opening of the movable door accomplished by the attendant through the use of a conveniently mounted handle; the transaction drawer further shown in the extended or opened position with the movable with the hinged, moveable security flap shown in a horizontal position and the cash box located within the transaction drawer with the lid to the cash box in its closed position.

FIG. 7 is a perspective view of the easily serviceable roller and bearing mechanism of the present invention, with the transaction drawer withdrawn from the frame (installed in the wall), and the interior side panels removed to facilitate servicing of the rollers and bearings supporting the transaction drawer.

Corresponding reference numbers indicate corresponding parts throughout the several views of the drawings.

DESCRIPTION OF PREFERRED EMBODIMENT

Figure 3:
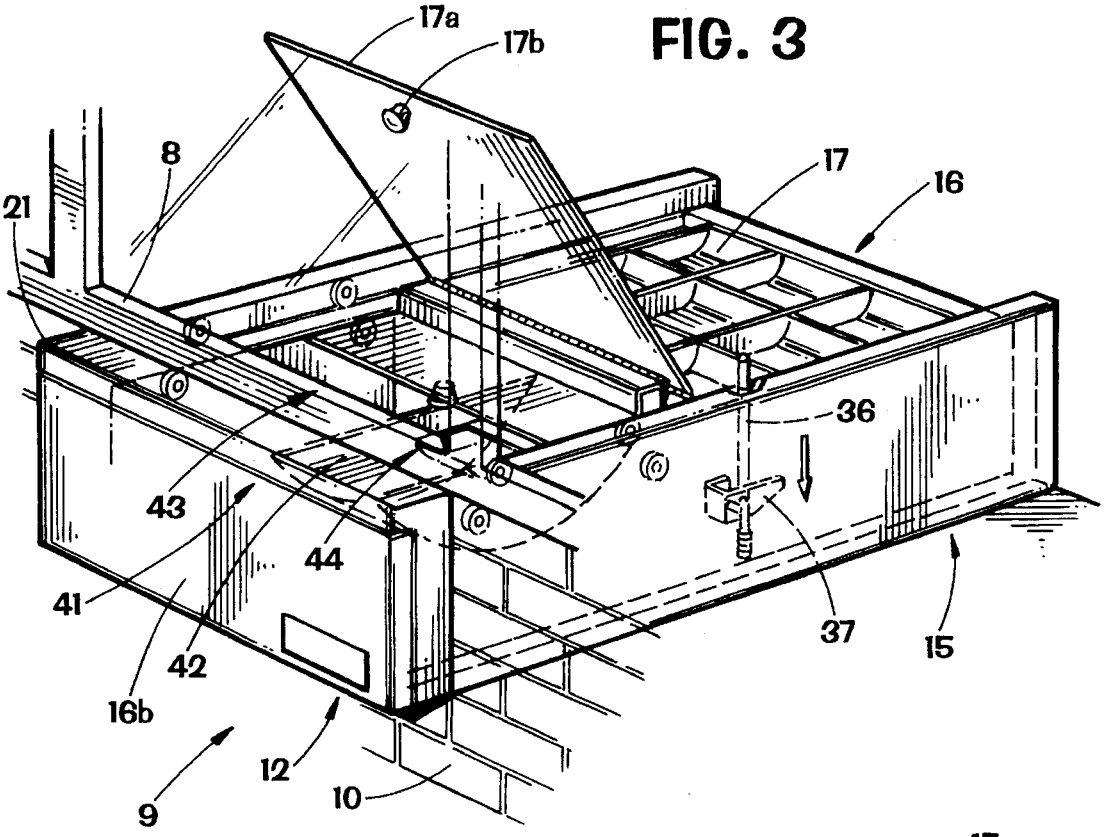
FIG. 3 is a perspective view of the pass-through transaction drawer of the present invention with a partial view of the outer wall and transparent pane of a building as described in FIG. 1; illustrating an alternate embodiment of the present invention, the transaction drawer installed within the opening below the transparent pane, with a relatively shallow compartmentalized transaction drawer shown in the retracted or closed position with the movable, hinged security flap shown in a horizontal position showing a cash box located within the transaction drawer with the lid to the cash box in its opened position.

Referring now to the drawings, a building as generally indicated at 9, is shown to have an outside wall 10 with a transaction drawer 16 of the present invention installed within an opening 12 through the wall of the building 9. A transparent pane such as a window 11 is typically located above the transaction drawer, with the lower edge of the transparent pane being mounted in a window mullion 8. Such buildings may, for example include an attendant's building located on a service island of a self-service gasoline station, or a walk-up teller's window at a bank, or a walkup window at an all-night convenience food store, a free-standing kiosk, or the like. The transaction drawer 16 of the present invention permits an attendant, teller, or clerk within the building to view customers through the transparent pane 11 and to transact business with the customers via the transaction drawer 16 by exchanging money, credit cards, change, and other articles between the attendant and the customer without permitting access by the customer to the cash register or cash box 17 within the building, and while maintaining the attendant or clerk within the relative security of a locked building.

Figure 1:
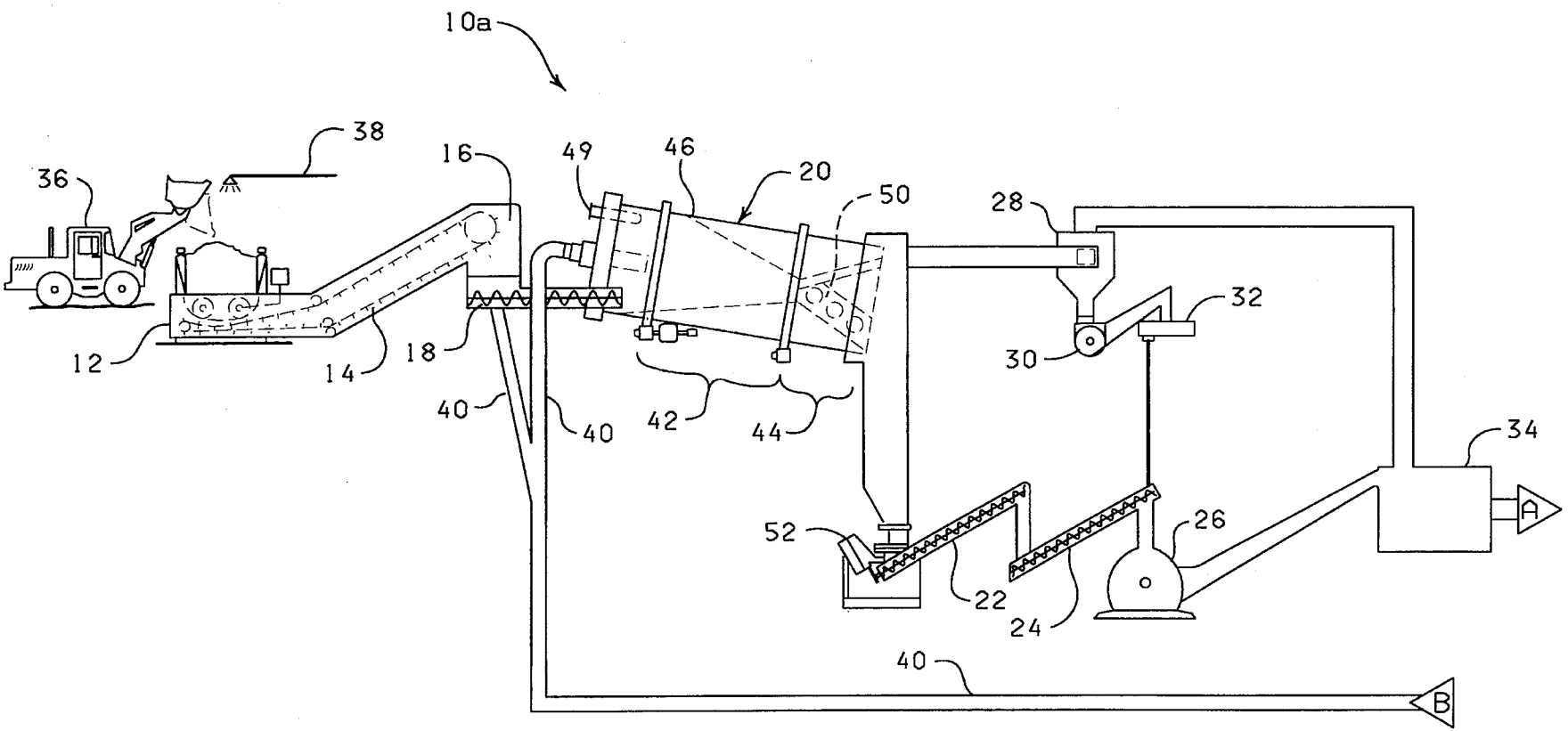
FIG. 1 is a perspective view of the pass-through transaction drawer of the present invention with a partial view of the outer wall of a building, such as a self-serve service station attendant's booth, kiosk, walk-up bank teller window, or the like, having an opening therein with a partial view of the transparent pane above the opening; with the pass-through transaction drawer of the present invention installed within the opening below the transparent pane so as to permit transactions between the attendant within the building or kiosk and a customer outside the building or kiosk, a relatively deep transaction drawer shown in the retracted or closed position with the movable, hinged security flap shown in a vertical position, and with a small change and credit card holder attached to the bottom side of the security flap.

As further shown in FIG. 1 the opening 12 through building wall 9 typically has an exterior opening frame 15 mounted therewithin for slideably mounting the transaction drawer 16 within the opening 12. Transaction drawer 16 is fitted with an ornamental faceplate **16*a*. Preferably the ornamental faceplate 16*a* is attached to the transaction drawer 16 from the exterior of the opening 12 to prevent the drawer from inadvertently sliding out of the frame 15 into the interior of the building. The break-away perspective view set forth in FIG. 7 more clearly illustrates the exterior opening frame 15 mounted through the opening 12 in the exterior building wall 9. The exterior opening frame 15 is constructed of side walls 18 and 19, bottom 20 and frame front 21. Frame front 21 is adapted to serve as a receptacle for ornamental faceplate 16*a* thereby limiting the inward travel of drawer 16. Window mullion 8 is mounted above frame front 21 with the exterior building wall constructed in close proximity to frame sides 18 and 19 and the underside of frame bottom 20. In this manner the building wall 9 and window mullion 8 serve to surround the bottom, sides, and top of the drawer frame 15 to seal off the building opening 12**.

Referring to FIG. 7, frame 15 has removable side interior panels 22 and 23 which cooperatively mate with frame 15 by means of recessed areas 26 and 27 so that the interior surface of panels 22 and 23 are flush with the interior surface of frame front 21. Panels 22 and 23 are attached to frame 15 by means of attaching means such as sheet metal screws 24 or other similar attachment devices. The transaction drawer 16 slides in frame 15 through opening 12 by means of wheels 28 attached to interior side panels 22 and 23 by means of a bolts 29 and nuts **29*a*. A concentric hole in wheel 28 provides a convenient attachment point through which bolt 29 penetrates wheel 28 in such a manner as not to interfere with the rotation of wheel 28. Wheels 28 have friction reduction means such as ball or roller bearings which are mounted concentrically about wheel 28 so as not to interfere with the mounting bolts 29. The circumference of wheels 28 is adapted to conform to the drawer guide and support members 35 attached to the sides of drawer 16. In the preferred embodiment, members 35 are "T" shaped with the top end of the "T" in a vertical plane at the farthest distance from the longitudinal centerline of the drawer 16**.

One of the innovative features of the present invention is the ease with which the wheels 28 can be replaced in the event the concentrically mounted roller or ball bearings require replacement due to wear. In order to replace wheels 28, the transaction drawer 16 is removed from frame 15. Removal is accomplished by depressing latch operator 36 and slideably moving the drawer 16 into the interior of the building (away from opening 12). Once the drawer is removed from frame 15, screws 24 are removed and thereafter interior panels 22 and 23 are removed. Once interior panels 22 and 23 are removed, bolts 29 and nuts 29a can be readily removed in order to replace wheels 28 and the accompanying roller or ball bearings. Reassembly is accomplished by reversing the above-described steps. Replacement of all wheels 28 can be accomplished in a minimum amount of time, thereby reducing the "down-time" for the drawer.

Figure 4:
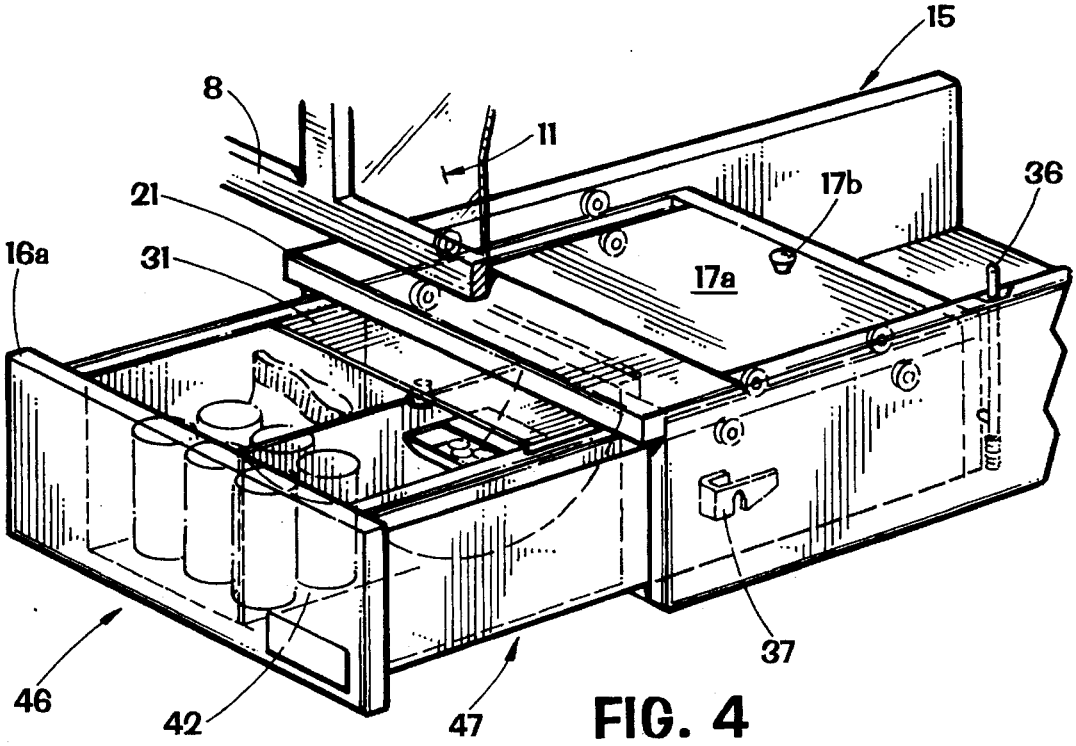
FIG. 4 is a view similar to FIG. 3, with a relatively deep compartmentalized transaction drawer shown in the extended or open position with the movable, hinged security flap shown in a horizontal position showing a cash box located within the transaction drawer with the lid to the cash box in its closed position.

Referring now to FIG. 1, the transaction drawer 16 is slideably housed within frame 15. Transaction drawer 16 includes a movable semicircular transaction tray 25, such drawer 16 being movable relative to the frame 15 between a retracted or closed position as shown in FIG. 1, in which the attendant within the building has access to the semicircular transaction tray 25, and an extended or open position, as generally shown in FIG. 4, in which the movable drawer 16 extends beyond frame front 21 such that a customer on the exterior of the building has access to the contents of transaction tray 25. In this manner, by moving the drawer 16 between its opened and closed positions, the customer and the attendant may readily transact business, transfer money and credit card, and transfer packages between the interior and exterior of the building without permitting the customer to have access to the interior of the building.

With the rising crime rate, one of the major drawbacks of the prior art transaction drawers is that a weapon can be inserted through the transaction tray when the transaction drawer is partially opened. This life-threatening possibility is more easily accomplished with deeper transaction trays and/or transaction trays which have greater lengths along the longitudinal axis. One of the prior art devices (such as the one illustrated in U.S. Pat. No. 4,640,200) attempted to solve this problem by providing a deep drawer to accommodate bulky items and thereafter sealing the deep portion of the drawer with an attendant-removable shallow transaction tray for small transactions (e.g. cigarettes, chewing gum, candy bars, credit cards, money, change, etc.). Although the attendant-removable transaction tray (when installed) minimizes the risk of an assailant inserting a weapon through a partially opened drawer, the removable tray, once removed by the attendant to convey bulky items to a customer completely defeated the security means. Alternatively, if the shallow transaction tray was not removed the deeper portion of the drawer was rendered useless and thereby prevented the conveyance of bulky items (e.g. beverage six-pak, carton of milk, etc.) by the attendant to a customer.

Referring now to FIG. 1, one of the innovative and useful features of the present invention is security flap 31 which is hingeably attached to the top surface of transaction drawer 16 by means of hinge 32. Security flap 31 is formed in such a manner so as to also provide a lip 38 which serves to limit the outward travel of transaction drawer 16. Travel of drawer 16 is limited when flap lip 38 abuts against the interior portion of the mullion 8 as shown in FIG. 8. When the transaction drawer is in the closed position, security flap 31 is hinged towards the attendant (by means of hinge 32) to expose the interior cavity of transaction tray 25 and thereby permit the deposit of items in transaction tray without any impediment from security flap 31. Once the items to be conveyed by the attendant to the customer are placed in the interior cavity of transaction tray 25, the security flap 31 is hinged away from the attendant and into a position such as that illustrated in FIG. 2. The security flap 31 is of a size to effectively block the opening in transaction tray 25 when the transaction drawer is partially open. The security flap 31 slides under the top portion of frame 21 thereby preventing a person on the outside of the building from moving the flap upward. Security flap 31 partially blocks the opening of transaction tray 25 when the transaction drawer 16 is fully opened, however this partial blockage does not hinder the removal of the contents of the transaction tray 25 by the customer. Security flap 31 may also be provided with a small contents tray 34 to further facilitate the transfer of money, credit cards, and the like between the customer and an attendant.

In the preferred embodiment, transaction drawer 16 is provided with a biased drawer latch operator 36 at the rearward portion of one of the drawer sides which can be readily depressed by an attendant within the building to release the drawer from a closed (and locked) position in order to extend the drawer from the closed position to an opened position. The biased latch operator also serves as a handle which may be readily grasped by the attendant to extend and retract the transaction drawer. Referring now to FIG. 7, the spring biased latch operator is provided with a stud **36*a* perpendicular to the longitudinal axis of the latch operator The stud 36*a* extends through an orifice through side panel 23. The stud 36a latches into stud receptacle 37 when the drawer is in the fully closed position. Stud receptacle 37 is fixedly attached to the exterior side of transaction drawer 16. Additionally the preferred embodiment of the present invention is fitted with a cash drawer 17 at the rearward portion of the transaction drawer 16. The cash drawer is preferably fitted with a cash drawer door 17*a* which closes off the cash drawer when access to the cash drawer is not required. Cash drawer door 17*a* is also preferably fitted with a cash drawer knob 17*b* to facilitate the opening of the cash drawer door 17*a***.

The transaction drawer, frame, partitions, side, bottom, and top wall members as well as the transaction trays are formed of rugged sheet metal construction of stainless steel or the like.

Referring now to FIG. 2, an alternate embodiment to the embodiment depicted in FIG. 1 is illustrated. FIG. 2 illustrates a transaction tray 25 shallower than the transaction tray illustrated in FIG. 1. With the exception of the tray depth, all other features illustrated in FIG. 1 (and described with respect to that figure) are similarly illustrated in FIG. 2. In this embodiment security flap 31 continues to provide protection from the insertion of weapons through partially-open transaction drawers.

Referring now to FIG. 3, an alternate embodiment of the present invention is depicted. The embodiment illustrated in FIG. 3 features a compartmentalized transaction tray 41, similar to transaction tray 25, however transaction tray 41 has an interior partition 42 which divides the transaction tray 42 into two cavities 43 and 44. In the embodiment depicted in FIG. 3 the cavities 43 and 44 are of the same depth. With the exception of the compartmentalized tray, all other features illustrated in FIG. 1 (and described with respect to that figure) are similarly illustrated in FIG. 3. In this embodiment the security flap 31 continues to provide protection from the insertion of weapons through partially-open transaction drawers.

Referring now to FIG. 4, an alternate embodiment of the present invention is depicted. The embodiment illustrated in FIG. 4 features a compartmentalized transaction tray (similar to compartmentalized transaction tray 41 illustrated in FIG. 3), however transaction tray 41 has an interior partition 42 (similar to that illustrated in FIG. 3) which divides the transaction tray 42 into a deep cavity 46 and a shallow cavity 47. Shallow cavity 47 accommodates the transfer of small articles including money and credit cards. Deep cavity 46 permits the transfer of bulky items such as oil, beverage six-paks, etc. With the exception of the compartmentalized tray with cavities of different sizes, all other features illustrated in FIG. 1 (and described with respect to that figure) are similarly illustrated in FIG. 3. In this embodiment the security flap 31 continues to provide protection from the insertion of weapons through partially-open transaction drawers.

Referring now to FIG. 5, an alternate embodiment of the present invention is depicted. The embodiment illustrated in FIG. 5 features a retractable shallow transaction tray 56 preferably hinged to the interior of a deep cavity transaction drawer 48. The retractable transaction tray 56 way be selectively moved from a first position 57 wherein the shallow transaction tray 56 is in use to transport small articles between the attendant to the customer. When the retractable transaction tray 56 is in the first position 57, the deep cavity transaction drawer 48 is blocked and cannot be used. In the event that large, bulky articles are to transported between the attendant and the customer, then the attendant selectively lowers the shallow transaction tray 56 to the second retracted position 58 by means of retraction lever 61 which is coupled to eccentric retraction operator 60 which in turn is coupled to the bottom side of the shallow transaction tray 56 by means on linkage 59. Preferably the interior back wall 63 of deep cavity transaction drawer 48 is suitably recessed to receive the retracted shallow transaction tray 56 in order to minimize the possibility of trapping foreign objects between the retracted shallow transaction tray 56 and back wall 63. With the exception of the retractable shallow transaction tray, all other features illustrated in FIG. 1 (and described with respect to that figure) am similarly illustrated in FIG. 5. In this embodiment the security flap 31 continues to provide protection from the insertion of weapons through partially-open transaction drawers.

Referring now to FIG. 6, an alternate embodiment of the present invention is depicted. The embodiment illustrated in FIG. 6 features the compartmentalized transaction drawer previously described with respect to FIGS. 3 and 4, however the transaction drawer further features a hinged front faceplate or door 66, which is hinged at hinge 65. The hinged faceplate or door 66 is selectively opened by an attendant by means of handle 71 which is coupled to an eccentric operator 70 which in turn is coupled to linkage 69 which is further coupled to the movable portion of faceplate 66. Selectively opening the faceplate 66 in the above-described manner will permit the attendant to selectively provide the customer with frontal access to the contents of the transaction drawer when top access is limited such as in the case of a drive-in window by a low profile automobile. With the exception of the selectively opening faceplate, all other features illustrated in FIG. 3 (and described with respect to that figure) are similarly illustrated in FIG. 6. In this embodiment the security flap 31 continues to provide protection from the insertion of weapons through partially-open transaction drawers.

In view of the above, it will be seen that the other objects of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A transaction drawer assembly comprising:

a transaction drawer within the transaction drawer assembly;

a frame adapted to be installed in an opening in the wall of a structure, said frame further adapted to permit the transaction drawer to move from a first retracted position in which said transaction drawer is within the structure such that the opening is closed, and a second forward extended position in which said drawer projects out beyond the wall of the structure;

said transaction drawer movably attached to the frame and being selectively forwardly extendable by an attendant within said structure between said first retracted position, and said second extended position;

a rearwardly hinged, forwardly extendable security flap wherein said forwardly extendable security flap partially covers the transaction drawer when the drawer is in the second forwardly extended position; and the security flap has a small contents tray.

2. A transaction drawer assembly comprising:

a compartmentalized transaction drawer within the transaction drawer assembly;

a frame adapted to be installed in an opening in the wall of a structure, said frame further adapted to permit the transaction drawer to move from a first retracted position in which said transaction drawer is within the structure such that the opening is closed, and a second forwardly extended position in which said drawer projects out beyond the wall of the structure;

said compartmentalized transaction drawer with at least one deep and one shallow cavity, movably attached to the frame and being selectively forwardly extendable by an attendant within said structure between said first retracted position, and said second forwardly extended position;

a rearwardly hinged, forwardly extendable security flap wherein said forwardly extendable security flap partially covers the compartmentalized drawer when the drawer is in the second forwardly extended position; and the security flap has a small contents tray.

3. transaction drawer assembly comprising:

a relatively deep transaction drawer within the transaction drawer assembly;

a frame adapted to be installed in an opening in the wall of a structure, said frame further adapted to permit the transaction drawer to move from a first retracted position in which said transaction drawer is within the structure such that the opening is closed, and a second forwardly extended position in which said drawer projects out beyond the wall of the structure;

said relatively deep drawer movably attached to the frame and being selectively forwardly extendable by an attendant within said structure between said first retracted position, and said second extended position, a selectively retractable hinged transaction tray movable from a first extended position in which said hinged transaction tray is used to hold small contents to be conveyed from the interior of the structure to the exterior of the structure, to a second retracted position in which the hinged transaction tray is retracted whereby an attendant can selectively retract the hinged transaction tray to convey larger contents which require full depth of the drawer;

a rearwardly hinged forwardly extendable security flap, wherein such rearwardly hinged forwardly extendable security flap partially covers the transaction drawer and is movable by an attendant when the drawer is in the retracted position; and the security flap has a small contents tray.

4. A transaction drawer assembly comprising:

a transaction drawer within the transaction drawer assembly;

a frame adapted to be installed in an opening in the wall of a structure, said frame further adapted to permit the transaction drawer to move from a first retracted position in which said transaction drawer is within the structure such that the opening is closed, and a second forwardly extended position in which said drawer projects out beyond the wall of the structure;

said drawer movably attached to the frame and being selectively forwardly extendable by an attendant within said structure between said first retracted position, and said second extended position, a selectively movable door mounted on the front of the drawer movable from a first closed position and a second open position whereby an attendant can forwardly extend the drawer from the first retracted position to the second extended position and thereafter selectively open the door to facilitate the removal of the contents through the opening in the front of the drawer;

a rearwardly hinged forwardly extendable security flap, wherein such rearwardly hinged forwardly extendable security flap partially covers the transaction drawer and is movable by an attendant when the drawer is in the retracted position, and the security flap has a small contents tray.

5. A transaction drawer assembly comprising:

a transaction drawer within the transaction drawer assembly;

a frame adapted to be installed in an opening in the wall of a structure, said frame further adapted to permit the transaction drawer to move from a first retracted position in which said transaction drawer is within the structure such that the opening is closed, and a second forwardly extended position in which said drawer projects out beyond the wall of the structure;

a drawer movably attached to the frame and being selectively forwardly extendable by an attendant within said structure between said first retracted position, and said second extended position;

a selectively movable door mounted on the front of the drawer movable from a first closed position and a second open position whereby an attendant can forwardly extend the drawer from the first retracted position to the second extended position and thereafter selectively open the door to facilitate the removal of the contents through the opening in the front of the drawer;

where the transaction drawer has at least one deep and one shallow cavity and further includes a rearwardly hinged forwardly extendable security flap, wherein such rearwardly hinged forwardly extendable security flap partially covers the transaction drawer and is movable by an attendant when the drawer is in the retracted position, and the security flap has a small contents tray.

* * * * *